US005725323A

United States Patent [19]

Wittek

[11] Patent Number: 5,725,323

[45] Date of Patent: Mar. 10, 1998

[54] WRITING APPLIANCE THAT CLOSES AUTOMATICALLY AFTER A GIVEN TIME INTERVAL

[75] Inventor: Gotz Ulrich Wittek, London, United Kingdom

[73] Assignee: Intergraph Office Innovation N.V., Netherlands Antilles

[21] Appl. No.: 337,149

[22] Filed: Nov. 9, 1994

Related U.S. Application Data

[63] Continuation of Ser. No. 752,618, Apr. 26, 1993, abandoned.

[30] Foreign Application Priority Data

Feb. 15, 1989 [DE] Germany ..... 39 04 578.1
Feb. 14, 1990 [WO] WIPO ..... PCT/EP90/00240

[51] Int. Cl.[6] ..... B43K 5/16; B43K 7/12

[52] U.S. Cl. ..... 401/114; 401/107; 401/109; 401/117

[58] Field of Search ..... 401/107, 108, 401/117, 114, 113, 112, 111, 110, 109, 99, 31, 32, 33

[56] References Cited

U.S. PATENT DOCUMENTS

| | | | |
|---|---|---|---|
| 3,181,507 | 5/1965 | Dannebaum | 401/112 |
| 3,230,934 | 1/1966 | Eriksson | 401/112 |
| 4,711,592 | 12/1987 | Gregory | 401/107 |
| 4,759,650 | 7/1988 | Granoff | 401/107 |
| 4,859,103 | 8/1989 | Wittek | 401/115 X |
| 5,022,773 | 6/1991 | Waldinger et al. | 401/107 |

FOREIGN PATENT DOCUMENTS

| | | | |
|---|---|---|---|
| 1252736 | 12/1960 | France | 401/115 |
| 1307934 | 9/1962 | France | 401/99 |
| 2607074 | 5/1988 | France . | |
| 1020256 | 11/1957 | Germany | 401/99 |
| 1942979 | 8/1969 | Germany | 401/99 |
| 3514012 | 4/1986 | Germany | 401/117 |
| 764791 | 2/1957 | United Kingdom | 401/109 |
| 2142284 | 1/1985 | United Kingdom . | |

*Primary Examiner*—Roberta A. Hafer
*Assistant Examiner*—D. Neal Muir
*Attorney, Agent, or Firm*—Handal & Morofsky

[57] ABSTRACT

A writing implement of the type that incorporates a writing element which has the characteristic of deteriorating in the presence of air is disclosed. It comprises a housing and a writing element contained in the housing. A bias member for urging the writing element into a retracted position and a sealing closure member which is configured to be closed by the housing in the retracted position are provided. A stud is associated with the writing element. A mating stud is associated with the housing and adapted to frictionally engage the stud. The coefficient of friction between the stud and the mating stud is insufficient to overcome the urging of the bias member and prevent movement between the studs, whereby the writing element is driven to the retracted position.

17 Claims, 2 Drawing Sheets

8
8
2
4
27
18
11
3
10
17
24
16
1
21
6
14
5
15
9
15 Min.
22
8
20 Min.
7

WRITING APPLIANCE THAT CLOSES AUTOMATICALLY AFTER A GIVEN TIME INTERVAL

This is a continuation application of Ser. No. 07/752,618, filed on Apr. 26, 1993, now abandoned.

DESCRIPTION

Such a writing implement is known from DE-OS 3,518,069. Said writing implement has a two-part closure for the associated cartridge. The two closure halves are provided on the inside with a rubber-like plastic member and are sealed by the deflected force of a very strong pressure spring.

The soft and hard plastic parts of this closure cooperate in such a manner that the writing tip or nib liable to dry out is sealed in pressurized gas-tight manner all round in the closure.

Furthermore, this writing implement has a control mechanism for coordinating the shifting of the cartridge into the writing state with the sealing closure in such a manner that neither the writing tip or nib nor the seals can be damaged.

This known writing implement is put into the writing state by actuating the rearward pushbutton as in a pressure ball point pen. The cartridge is then locked by a direct shift system in the advanced state, the closure controlled directly parallel thereto moving back behind the cartridge. Although this known writing implement meets all the requirements necessary for economic and absolutely reliable automatic closure, a frequent problem when using such writing implements resides however in that the user, particularly when they are occupied with something else for a short time, simply leave the liquid writing implement unsealed, as they are used to do with ball point pens, and as a result the implements start drying out. This forgetting to close the pen arises independently of whether the liquid writing implement has a closure operable by pushbutton or a common push-on cap. The basic problem of liquid writing implements, that is that one forgets to close them, is thus not solved by the closability by pushbutton on its own.

The invention is therefore based on the problem of providing a writing implement of the type mentioned at the beginning which closes automatically after a fixedly defined time.

This problem is solved according to the invention in a writing implement of the type set forth at the beginning by the features of the characterizing clause of the main claim.

In this liquid writing implement drying of the writing tip when the writing implement is left lying open is avoided by an incorporated element acting like a time switch, said element closing the writing implement automatically after a predetermined possibly adjustable period of time.

To fulfill this function the writing implement of the type described at the beginning is largely modified except for the closure. The writing implement consists then only of an outer sleeve, a pressurized-gas-tight closure, a lead or cartridge and a time switch element acting between the cartridge and the outer sleeve. In the advanced writing state the cartridge is no longer in a fixed anchoring on the outer housing, as is generally usual for example in ball point pens, but is above a nose on the front cartridge tip in an unstable anchoring cooperating with the time switch element.

In a preferred embodiment the time switch element is arranged in a separate grip zone mounted on the outer sleeve. On pushing the cartridge forward into the writing position the cartridge comes into unstable engagement with the time switch element. As long as writing is carried out with the writing implement of the this preferred embodiment, as a rule the index finger, thumb and middle finger press into the three depressions of the grip zone provided for them and one of the three grip zones is preferably an individual part which can be moved independently of the outer sleeve and transmits the pressure of the writing hand onto the engaged nose. The pressure between the unstable anchoring (or the time switch means) and the nose of the cartridge engaged therein becomes greater, and indeed considerably greater due to leverage effects caused thereby. The result of this is that during the writing the unstable anchoring of the cartridge becomes a stable anchoring. Thus, for as long as writing is continued the cartridge is anchored just as firmly as otherwise usual.

When however the user has stopped writing with the liquid writing implement, the pressure intensification on the engagement of the cartridge caused by the leverage effect ceases again and the locking engagement thereby becomes unstable again.

After a predetermined time, which can be defined previously via the configuration of the unstable locking engagement (for example 15 minutes), the cartridge releases itself from the locking engagement in the advanced position and moves on its own completely automatically into the closure state without further external action.

In other embodiments of the writing implement having other forms of the closure by pushbutton actuation, a similar procedure is adopted in order to anchor the cartridge in stable manner when writing and in unstable manner when not being used for writing. Consequently, this time switch mechanism may be applied to every conceivable system of cap closure by pushbutton or turning, etc.

In further embodiments of the writing implement the time switch function is performed by other mechanisms, for example electronics which via the hand warmth, the writing movements or the diagonal/horizontal position of the writing implement detect whether or not said implement is being used for writing and if this is not the case after a predetermined preselectable time release the locking engagement of the advanced cartridge, the latter thereupon moving automatically into the closure state.

In other embodiments of the writing implement the detection whether or not writing is going on is also possible via an air/gas/water system which during writing is compressed via the grip zone and passes the pressure of the fingers onto a holding system for the writing element.

In other embodiments the detection whether the implement is in a diagonal position (=writing) or in the horizontal/vertical position (=not writing) is also possible by a magnetic system or by a gas/water system (principle of the spirit level).

Hereinafter an example of embodiment of the writing implement will be described in detail with the aid of the attached drawings.

DESCRIPTION OF THE PREFERRED EMBODIMENTS

The example of embodiment of the writing implement shown in FIGS. 1–8 comprises a one-part outer sleeve 2 and a one-part closure 1 (FIG. 1*b*) which can be folded open into halves 12 (FIG. 3) via a film hinge 19.

Figures 1, 1A, 1B, 2:
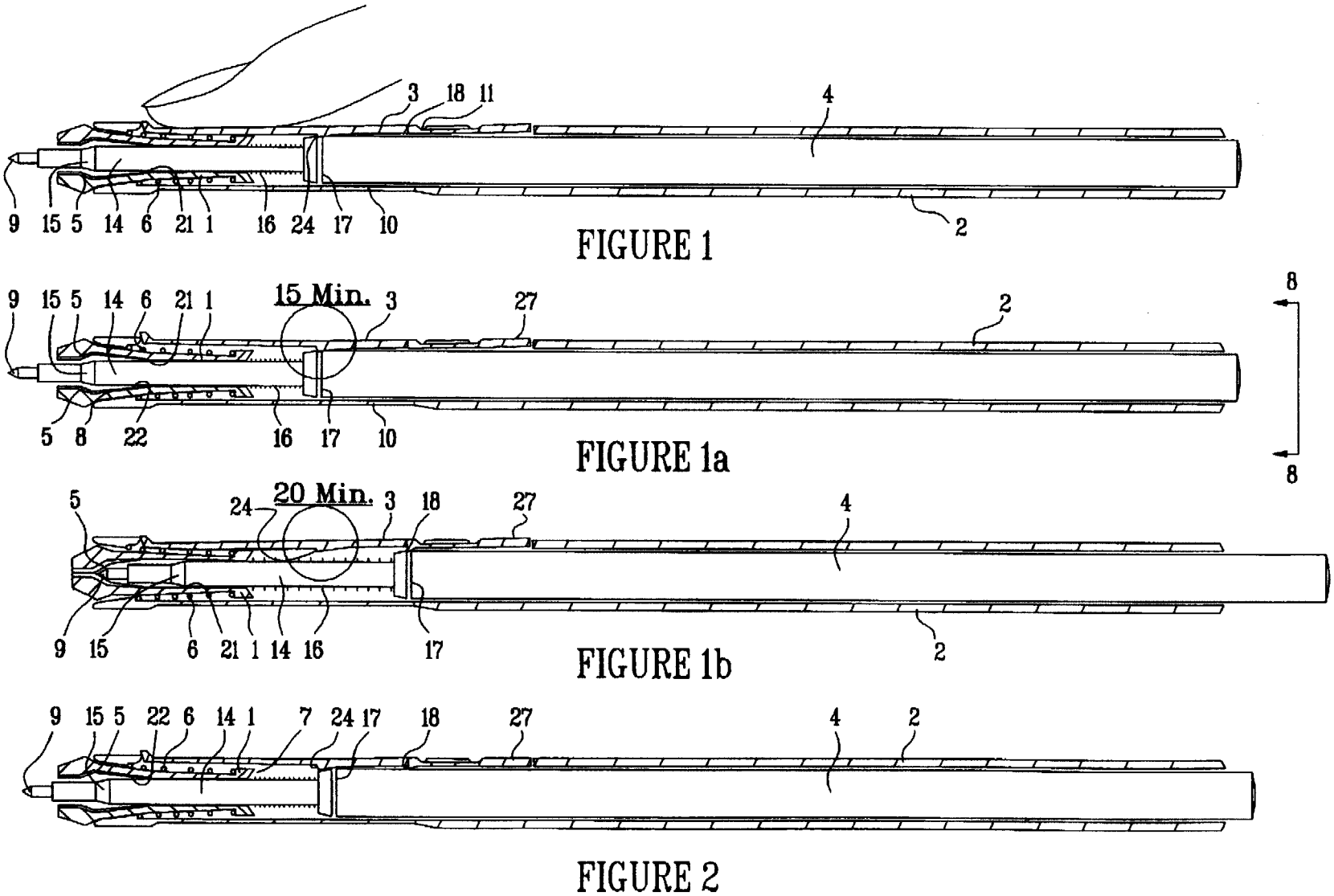
FIG. 1 shows a longitudinal section through an embodiment of the writing implement in the writing position during writing.
FIG. 1*a* shows a longitudinal section through the writing implement according to FIG. 1 in the writing position when not writing.
FIG. 1*b* shows a longitudinal section through the writing implement according to claim 1 in the closure position.
FIG. 2 shows a longitudinal section through the writing implement according to FIG. 1 which is just about to switch automatically or by pressure actuation into the closure state.
Figure 3:
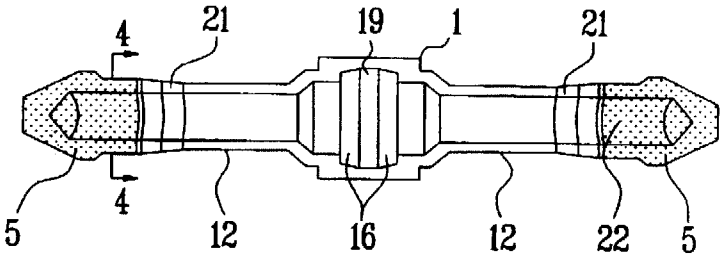
FIG. 3 is a plan view of the opened closure 1.
Figure 4:
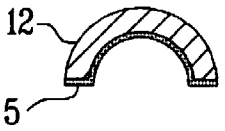
FIG. 4 is a cross-section through the closure of FIG. 3.
Figure 5:
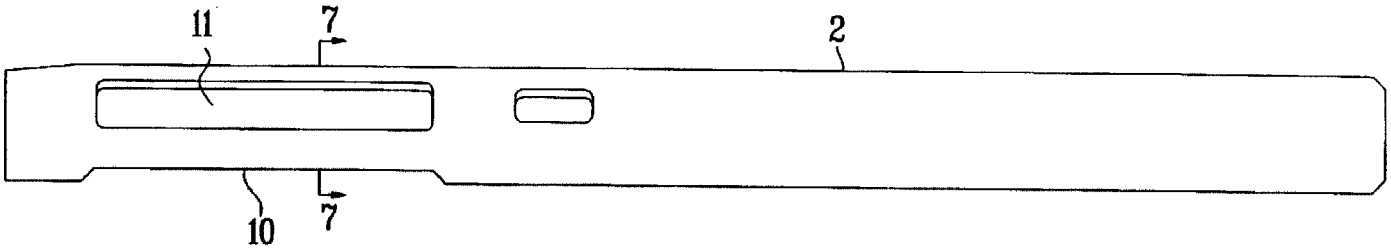
FIG. 5 shows a plan view of the outer sleeve 2.

The closure halves 12 of the closure 1 are each provided on the inside with an elastic sealing half shell 5 (FIGS. 1 and 3). The closure 1 is biased by a strong pressure spring 6 against the outer sleeve 2 and is compressed in the manner of clamping tongs by a closure cone 8 at the front opening of the outer sleeve 2, the elastic sealing half shells 5 being closed under high pressure (FIG. 1*b*).

Figure 7:
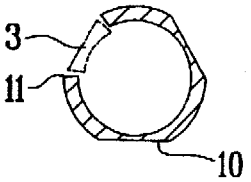
FIG. 7 is a cross-section through the grip zone of the outer sleeve 2 of FIG. 5.
Figure 6:
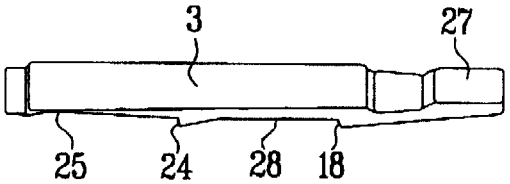
FIG. 6 shows a plan view of the separate grip zone part 3 with time switching.

Furthermore, the writing implement comprises a lead, refill or cartridge 4 which is arranged in the outer sleeve 2. The cartridge 4 is biased via a small spring 7 against the closure 1; to keep the length of the cartridge tip 14 and thus the length of the writing wick as short as possible, the spring 7 sinks partially into a special spring pocket 16 which is let into the rear end of the closure 1 (for example FIGS. 1 and 3). In the closure state (FIG. 1*b*) the cartridge 4 is supported rearwardly against a projection 18 via a special shoulder 17 disposed at the cartridge tip 14. The writing tip 9 of the cartridge 4 which is liable to dry out is sealed hermetically in pressure-resistant manner within the sealing half shells 5 of the closure 1 during the closure state (FIG. 1*b*). Finally, in the front region of the outer sleeve 2 the writing implement comprises a grip zone 10 consisting of three grip depressions (FIGS. 1, 5 and 7), one of the grip depressions consisting of a separate grip zone part 3 (FIG. 6) which is located in a special recess 11 (FIGS. 5 and 1) of the outer sleeve 2 (FIGS. 1, 6 and 7).

To move the writing implement to the writing state (FIGS. 1, 1*a*), instead of an otherwise usual pushbutton the end 13 (FIG. 8) of the cartridge 4 projecting out of the outer sleeve 2 is itself depressed (from FIG. 1*b* to FIG. 1*a*). When this is done the opening shoulder 15 of the cartridge tip 14 meets the opening projection 21 within the closure 1, the two halves 12 of the closure 1 thereby being opened. The opening operation proceeds in such a manner that the elastic seals of the sealing half shell 5 are not contacted by the writing tip 9. The rear seal 22 of the sealing half shell 5 bearing directly on the cartridge tip 14 is lifted during the opening after a very short grazing movement (about 0.5 mm) from the cartridge tip 14 as well so that it is not contacted by the cartridge tip 14 during the entire advance or during writing. In spite of the simplicity of the opening control this achieves a long life both of the seal outwardly and inwardly (rear seal 22). Once the writing tip 9 has moved far enough out of the closure 1 for the writing state, the shoulder 17 of the cartridge 4 engages into the time switch projection 24 at the grip zone part 3 (FIG. 1*a*).

This supporting is however a relatively unstable supporting. It is only when the user then starts to write that the supporting of the cartridge 4 becomes stable (FIG. 1). This is effected in that during writing one of the three writing fingers presses onto the grip zone part 3 and due to a certain leverage the time switch projection 24 is thereby pressed somewhat more strongly than when not writing onto the shoulder 17 of the cartridge 4 (FIG. 1). This slight intensification of the pressure from the grip zone part 3 via the time switch projection 24 onto the shoulder 17 is thus sufficient to keep the locking engagement of the cartridge 4 in the writing state continuously stable during writing.

Now, if writing ceases and the writing implement is simply left lying open as most users are used to doing with ball point pens, the additional pressure on the time switch projection 24 (FIG. 1*a*) is eliminated. For a time the supporting of the cartridge 4 via the shoulder 17 and the part 24 remains relatively stable so that the writing implement can be taken up at any time and again used for writing.

If however the writing implement is left lying beyond this constructionally definable time (for example 15 minutes), the grip zone part 3 is slowly raised over the time switch projection 24 by the shoulder 17, this being caused by the force of the spring 7 against the cartridge 4. The lifting of the grip zone part 3 is also facilitated in that the front portion 25 of the grip zone part 3 is made thinner and elastically flexural whilst the rear part 28 is made thicker and unelastic.

The locking engagement of the cartridge 4 thus gradually changes from a stable to an unstable engagement. Now, if the grip zone part 3 is lifted beyond a predetermined point the locking engagement between the time switch projection 24 and the shoulder 17 and the cartridge 4 loses its rear support (FIG. 2). As a result, the cartridge 4 is pushed back via the pressure of the spring 7 and the closure 1 closes and again hermetically seals the writing tip 9 (FIG. 1*b*).

The pushing back of the cartridge 4 does not take place abruptly but is slightly retarded because during it the pressure of the opening projections 21 on the cartridge is maintained and dampens the force development of the spring 7. In this manner the ink supply is moved back with the cartridge 4 without shaking and consequently any tendency to run out is avoided, and this means that the cartridge 4 can easily be equipped with a high writing performance or a large ink supply.

Since the shoulder 17 of the cartridge 4 at different segments round said cartridge 4 has different slopes with which it can come to bear on the time switch projection 24, the time after which the writing implement automatically closes can be varied by the user. Instead of different angles or slopes, other features may be provided on the shoulder 17 for changing the time rundown, for example different surfaces and forms, etc., at the individual segments of the shoulder 17. The change of the closure time 23 associated with the individual engagement angles of the shoulder 17 can be read at the rear end 13 of the cartridge 4 via the time setting notch 20.

If the closure time of the writing implement is too fast or too slow for the user he can lengthen or shorten it by turning the cartridge 4 projecting rearwardly from the outer sleeve 2. The user can also correct here any variation widths of the constructionally predefined closure time which might be caused by mass production.

Apart from this individual setting, the automatic closure time can be constructionally predefined by a number of factors. These include firstly the form and nature of the grip zone part 3, how thin or thick the front elastically flexural portion 25 and the rear less elastic part 28 are made (FIGS. 6 and 2). This further includes the form and nature of the surface of the time switch projection 24 and the shoulder 17. An important part is also played by the materials from which the components of the time mechanism are made. It is for example conceivable to make the time switch projection 24 together with the grip zone 3 from a harder material with rough surface and the shoulder 17 from a softer material with smooth surface, etc.

A further possibility of influencing the closure time resides in that on one or more of the portions stably supporting the writing state, for instance 17, 24 or 3, the surface of the part otherwise consisting of hard material is coated with a soft plastic, further retarding the mutual sliding engagements of the detents. It is furthermore also possible to work certain patterns into a somewhat enlarged time switch projection 24 which engage with corresponding patterns in the matching shoulder 17 in unstable manner.

A further possibility resides for example in that on the inner side of the grip zone part 3 a small pivotal flap is integrally cast which cooperates with a corresponding projection in the region of the shoulder 17 so that when the cartridge 4 slides back said pivot flap must first briefly raise the grip zone part 3 before the cartridge loses its rear support and switches to the closure state. The regulation of the time rundown can also be assisted in that the inner regions of the outer sleeve 2 lying opposite the shoulder 17 in the writing state are likewise incorporated into the switch rundown. For example, certain angles or projections here can press the shoulder 17 during the sliding back of the cartridge against the projection 24, or the inner surface nature of the outer sleeve 2 can likewise cooperate with the shoulder 17 in a manner previously described for the possibilities between the time switch projection 24 and shoulder 17.

Furthermore, a great variety of possible combinations of all these factors: Material properties, elasticity, surface, shape, engagement angles, etc., all these being conceivable in accordance with the result desired.

An important part is also played by the nature and pressure strength of the pressure spring 7 and the pressure spring 6.

Figure 8:
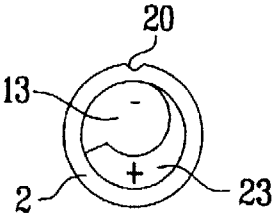
FIG. 8 shows a plan view of the rear portion of the writing implement of FIG. 1*b*.

It is expedient to make the constructionally predefined closure time relatively long, for example 15 minutes, in the case of writing implements with normal inks less prone to dry, and correspondingly shorter, for example 5 minutes in the case of writing implements with rapidly evaporating alcoholic inks. The individual regulatability could for example be designed for a one to three times extension of the closure time set and the present example of embodiment also has a setting (D=permanent operation) for switching off the automatic closure (FIG. 8).

On the other hand, a position "W" would also be possible, in which the shoulder 17 is completely removed and the cartridge 4 can be pulled out and changed.

If on the other hand it is desired to immediately close the writing implement (FIG. 1*a*) in the writing state, for example in order to take it away, the closure button 27 located at the end of the rear lever of the grip zone part 3 (FIG. 2) is simply pressed. As a result, the time switch projection 24 is unlocked from the shoulder 17 immediately without delay (FIG. 2) and the cartridge 4 slides under the pressure of the spring 7 into the writing implement, where the writing tip 9 is again hermetically sealed by the closure 1 (FIG. 1*b*).

I claim:

1. A writing implement, comprising:

(a) a housing;

(b) a writing element contained in said housing;

(c) a bias member for urging said writing element into a retracted position;

(d) a sealing closure member which is configured to be closed by the housing in the retracted position;

(e) a shoulder associated with said writing element; and (f) a lever having a time-switch projection positioned to frictionally engage said shoulder, said time-switch projection maintaining for a period of time, without external influence, said writing element in a position external to said housing and suitable for writing, said lever being tiltably mounted on said housing and having a release mechanism on one end of said lever, said release mechanism being positioned for immediate release of said time-switch projection from said shoulder when said release switch is depressed, the coefficient of friction between said shoulder and said time switch projection being of a value to cause friction insufficient to overcome the urging of said bias member and insufficient to prevent slow movement between said shoulder and said time switch projection, allowing the time switch element to be driven by said bias member along a path of movement from a beginning position to a position where said shoulder and said time switch projection disengage and said writing element moves to the retracted position.

2. A writing implement according to claim 1 characterized in that said retaining element is maintained in the engaged position as long as a user-applied gripping pressure is applied and said delay time starts when the user-applied gripping pressure is removed.

3. A writing implement, as in claim 1, wherein said shoulder and said time switch projection are positioned and supported to be pressed toward each other when said writing implement is gripped by the fingers of a user, maintaining said time switch projection at the beginning position of its path of movement during writing.

4. A writing implement, as in claim 1, wherein said time switch projection further comprises a gripping surface, said gripping surface being positioned and supported to be pressed toward said shoulder thereby augmenting said coefficient of friction between said shoulder and said time switch projection during writing.

5. A writing implement as in claim 1, wherein said time switch projection further comprises a gripping surface, said gripping surface being positioned and supported to be pressed toward said shoulder thereby augmenting said coefficient of friction between said shoulder and said time switch projection during writing, said gripping surface being inclined such that said shoulder comes free by lateral yielding after a defined interval of time.

6. A writing implement as in claim 5, wherein said gripping surface has an inclined surface and said surface is roughened.

7. A writing implement as in claim 1, wherein said time-switch projection is coated with soft plastic or rubber.

8. A writing implement as in claim 1, wherein said lever has a first and second end, said first end having said release switch and said second end being freely accessibly for a user to place an urging force upon said lever thereby transferring said urging force to said time switch projection, said urging force maintains said tip or nib in a writing position.

9. A writing implement as in claim 1, wherein a portion of said lever is made flexurally stiffer than other portions of said lever, said portion being located between the time-switch projection of said lever and the release switch.

10. A writing implement as in claim 1, wherein said lever has a second time-switch projection positioned on said lever.

11. A writing element as in claim 1, wherein said time-switch projection is biased towards said writing element.

12. A writing implement, comprising:

(a) a housing;

(b) a writing element contained in said housing, said writing element being adjustably mounted within said housing;

(c) a bias member for urging said writing element into a retracted position;

(d) a sealing closure member which is configured to be closed by the housing in the retracted position;

(e) a shoulder associated with said writing element, said shoulder having a plurality of inclined surfaces of different inclination; and (f) a time-switch projection associated with said housing and adapted to frictionally engage said shoulder, said time-switch projection maintaining for a period of time, without external influence, said writing element in a position external to said housing and suitable for writing, the coefficient of friction between said shoulder and said time switch projection being of a value to cause friction insufficient to overcome the urging of said bias member and insufficient to prevent slow movement between said shoulder and said time switch projection, allowing the time switch element to be driven by said bias member along a path of movement from a beginning position to a position where said shoulder and said time switch projection disengage and said writing element moves to the retracted position, said adjustable mounting of said writing element allows said inclined surfaces to be adjustably positioned thereby enabling different closure times.

13. A writing implement as in claim 12, wherein said different closure times are set by turning and setting said writing element.

14. A writing implement as in claim 12, wherein the difference in the inclination of said inclined surfaces is continuous.

15. A writing implement as in claim 12, wherein said plurality of inclined surfaces are of different roughness.

16. A writing implement as in claim 12, wherein said shoulder is coated with soft plastic or rubber.

17. A writing implement as in claim 16, wherein said time-switch projection is coated with soft plastic or rubber.

* * * * *